US008319437B2

(12) United States Patent
Carlin et al.

(10) Patent No.: US 8,319,437 B2
(45) Date of Patent: Nov. 27, 2012

(54) MODULAR LED LIGHTING SYSTEM

(75) Inventors: Steven W. Carlin, Lake Forest, CA (US); Bob Chen, Diamond Bar, CA (US); Fred Chen, Hacienda Heights, CA (US)

(73) Assignee: Pacific Dynamic, Newport Beach, CA (US)

( * ) Notice: Subject to any disclaimer, the term of this patent is extended or adjusted under 35 U.S.C. 154(b) by 464 days.

(21) Appl. No.: 12/709,384

(22) Filed: Feb. 19, 2010

(65) Prior Publication Data

US 2011/0115382 A1 May 19, 2011

Related U.S. Application Data

(63) Continuation-in-part of application No. 12/621,351, filed on Nov. 18, 2009.

(51) Int. Cl.
*H05B 37/02* (2006.01)
*H01J 13/32* (2006.01)

(52) U.S. Cl. ..... 315/113; 315/294; 362/217.13

(58) Field of Classification Search ..... 315/113, 315/209 R, 51, 246, 294, 297; 362/217.01, 362/217, 13, 217.14
See application file for complete search history.

(56) References Cited

U.S. PATENT DOCUMENTS

| | | | | |
|---|---|---|---|---|
| 6,762,562 | B2 | 7/2004 | Leong | |
| 6,936,968 | B2 | 8/2005 | Cross et al. | |
| 7,067,992 | B2 * | 6/2006 | Leong et al. | 315/291 |
| 7,114,830 | B2 * | 10/2006 | Robertson et al. | 362/240 |
| 7,507,001 | B2 | 3/2009 | Kit | |
| 2007/0013322 | A1 | 1/2007 | Tripathi et al. | |
| 2007/0041220 | A1 | 2/2007 | Lynch | |
| 2007/0047243 | A1 | 3/2007 | Hacker et al. | |
| 2007/0228999 | A1 * | 10/2007 | Kit | 315/291 |
| 2008/0165535 | A1 | 7/2008 | Mazzochette | |
| 2009/0091467 | A1 | 4/2009 | Ries, II | |
| 2011/0309745 | A1 * | 12/2011 | Westermarck et al. | 315/51 |

OTHER PUBLICATIONS

National Semiconductor; Nuventix and National Semiconductor Thermal and Electronic Drive Solution for LED Bulb Applications; printed on Jul. 20, 2010 at www.nuventix.com.
Osram; Optotronic Electronic Constant Current LED Power Supplies; printed on Jul. 20, 2010 at www.sylvania.com.

* cited by examiner

*Primary Examiner* — Don Le
(74) *Attorney, Agent, or Firm* — David E. Heisey; Sheppard, Mullin, Richter & Hampton

(57) ABSTRACT

According to various embodiments of the invention, an LED lighting system is providing having a replaceable driver module. In some embodiments, the replaceable driver module comprises a component that is physically attachable to an LED illumination module, whereby the attached components have a combined physical profile dimensioned for installation in a pre-existing light fixture. In further embodiments, the combined system's dimensions allow it to be installed in pre-existing fluorescent fixtures without requiring rewiring of the fixtures. In some embodiments, the LED driver module may be configured to condition power received from a fluorescent light ballast to drive the LEDs such that a pre-existing fluorescent ballast does not need to be removed. In other embodiments, the LED driver may be configured to condition main power such that a pre-existing fluorescent ballast may be removed.

18 Claims, 11 Drawing Sheets

MODULAR LED LIGHTING SYSTEM

RELATED APPLICATIONS

This application is a continuation-in-part of and claims the benefit of U.S. patent application Ser. No. 12/621,351 filed on Nov. 18, 2009, the content of which is incorporated herein by reference in its entirety.

TECHNICAL FIELD

The present invention relates generally to lighting systems, and more particularly, some embodiments relate to modular lighting systems.

DESCRIPTION OF THE RELATED ART

Light emitting diodes (LEDs) represent an attractive option as a potential replacement technology for incandescent and fluorescent lighting systems. LED lighting systems are often more efficient and frequently have a much longer potential life span than the systems they are designed to replace. For example, a typical LED light tube for replacement of a fluorescent troffer style light bulb may have a rating of more than 50,000 hours.

Different components that make up an LED light system may have varying costs and lifespans. The these different components may all have varying lifespans. Accordingly, the lifespan of the light as a whole is generally limited to the first component to break. In some cases, the LEDs themselves might have a virtually unlimited lifespan when kept under proper temperatures. The LED driver or ballast may be a major contributing factor in lifespan. For example, the LED driver itself may have a limited lifespan, for example 20,000-50,000 hours. Furthermore, different components can effect the lifespans of other components through their interactions. For example, the LED driver may generate heat that reduces the lifespan of the LEDs. Accordingly, for LED systems having fixed components, the lifespan of such a system is no greater than 20,000-40,000 hours.

BRIEF SUMMARY OF EMBODIMENTS OF THE INVENTION

According to various embodiments of the invention, an LED lighting system is providing having a replaceable driver module. In some embodiments, the replaceable driver module comprises a component that is physically attachable to an LED illumination module, such that the attached components have a combined physical profile dimensioned for installation in a pre-existing light fixture. In further embodiments, the combined system's dimensions allow it to be installed in pre-existing fluorescent fixtures without requiring rewiring the fixtures. In some embodiments, the LED driver module may be configured to condition power received from a fluorescent light ballast to drive the LEDs such that a pre-existing fluorescent ballast does not need to be removed. In other embodiments, the LED driver may be configured to condition main power such that a pre-existing fluorescent ballast may be removed.

According to an embodiment of the invention, a modular lighting system comprises an illumination module comprising a first housing and a plurality of electrically coupled LEDs disposed within the within the first housing; a driver module comprising a second housing configured to physically couple and de-couple from the illumination module, and an LED driver disposed within the second housing and configured to provide an electrical current to drive the plurality of LEDs when the driver module is coupled to the illumination module.

According to a further embodiment of the invention, the illumination module and the driver module have form factors such the system is installable in a pre-existing troffer light fixture when the driver module is coupled to the illumination module.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward an LED lighting system having a replaceable, driver module. In some embodiments, the replaceable driver module comprises a component that is physically attachable to an LED illumination module, such that the attached components have a combined physical profile dimensioned for installation in a pre-existing light fixture. In further embodiments, the combined system's dimensions allow it to be installed in pre-existing fluorescent fixtures without requiring rewiring the fixtures. In some embodiments, the LED driver module may be configured to condition power received from a fluorescent light ballast to drive the LEDs such that a pre-existing fluorescent ballast does not need to be removed. In other embodiments, the LED driver may be configured to condition main power such that a pre-existing fluorescent ballast may be removed. In further embodiments, other components of the LED light system are also replaceable.

In various embodiments, the replaceability of the modules described herein allows the modules to be repaired or upgraded, thereby eliminating the need to replace the entire module for technological upgrades or system failures. For example, future LEDs may be produced that are more efficient or that have more desired light characteristics, such as a greater luminosity or more preferred color temperature. Accordingly, the some embodiments described herein, an illumination module may be replaced with such an upgraded LED technology with requiring entire system replacement.

The replaceable modules described herein also ease the reparability of the described systems. For example, the replaceability of a driver module, as described herein, allows failed driver modules to be repaired. In some such embodiments, the driver modules themselves have replaceable, upgradeable, or reparable modularity. For example, rather than a sealed driver module, a driver module may be open such that its components are accessible and replaceable or upgradeable. Furthermore, replacing or repairing components of the system in a modular fashion significantly reduces the carbon footprint of the system as a whole over systems requiring complete replacement when any component fails.

Figure 1:
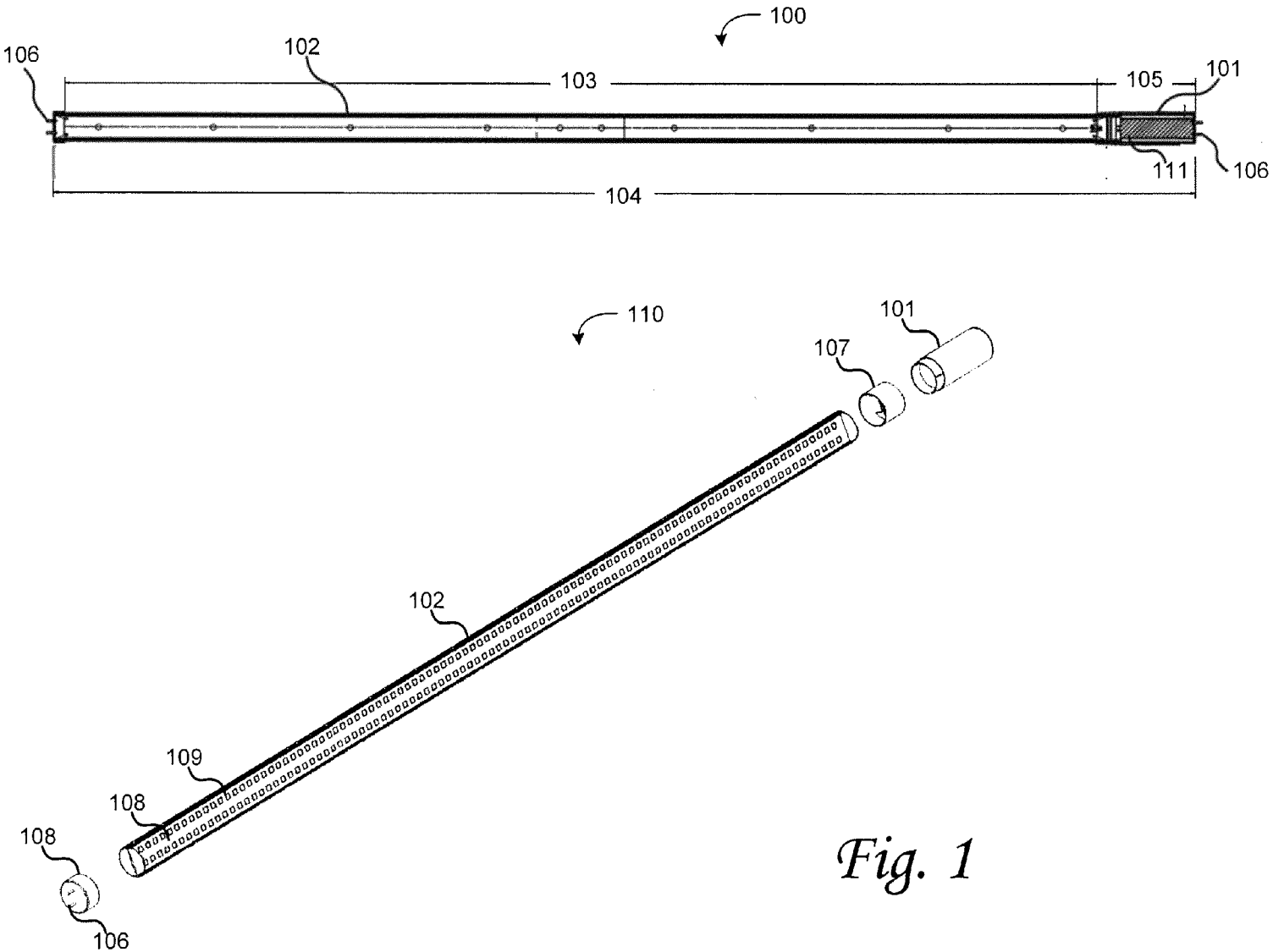
FIG. 1 illustrates a side view and a perspective exploded view of an LED lighting system according to an embodiment of the invention.

FIG. 1 illustrates a side view 100 and a perspective exploded view 110 of an LED lighting system according to an embodiment of the invention. The illustrated embodiment comprises a driver module 105 that is attachable to an LED illumination module 103. The illustrated driver module 105 comprises a driver circuit 111 disposed within a driver housing 101. A pair of electrical contacts 106 are further attached to the housing 101 and are electrically coupled to the driver circuit 111. In various embodiments, driver circuit 111 may comprise any suitable electrical circuit configured to condition electricity for powering a plurality of LEDs 109. For example, the driver circuit may comprise a conventional constant current source configured to convert electricity received via contacts 106 to have suitable characteristics for LED use.

The illustrated illumination module 103 comprises a housing 102 having a plurality of LEDs 109 disposed within. In this embodiment, the LEDs are configured to be powered by electricity received from the driver module 105 when the illumination module 103 is connected to the driver module 105. In some embodiments, the LEDs may be coupled to a circuit board 108 in a conventional manner, and the circuit board 108 may be configured such that it is placed in electrical communication with pins 106 and LED driver circuit 111 when the driver module 105 is coupled to the illumination module 103.

In some embodiments, coupling between the driver module 105 and the illumination module 103 may be mediated by a coupling module 107. In the illustrated embodiment, coupling module 107 comprises a cap 107 that is configured to engage with the housing 102 of illumination module 103. In some embodiments, cap 107 may be configured to be disengageable, for example to allow eventual replacement of the LED board 109, thereby further increasing system usefulness. Cap 107 further comprises a receptacle that is configured to receive the housing 101 of the LED driver module 105 in a removable manner. In some embodiments, the removeablity of LED driver module 105 allows the driver module 105 to be replaced after the driver 111 has reached its end of life. Accordingly, the lifetime of the illustrated LED lighting system may be extended so that it is limited by the LED illumination module 103's lifetime duration rather than the driver 111's lifetime. Further, in the illustrated embodiment, the driver module 105 is physically displaced from the illumination module 103. Accordingly, heat generated by the driver module 105 may dissipate during system operations without significantly impacting the heat conditions inside the illumination module 103. In such embodiments, heat sinks within the illumination module 103 may be chosen according to the heat generation characteristics of the LEDs without regard to the heat generation characteristics of the LED driver circuit 111. In typical embodiments, the LEDs themselves may generate significantly less heat than the driver circuit 111. Accordingly, in these embodiments, a smaller and more cost-efficient heat sink may be employed within the illumination module 103 than would be required with an internally disposed driver circuit.

A second cap 113 may further be provided to engage with the housing 102 of illumination module 103. In some embodiments, this cap 113 may be permanently joined with the housing 102 to provide a permanent electrical interface between pins 106 and the LED circuit 108. In other embodiments, cap 113 may be configured to be removable, for example to environmentally seal the illumination module 103 when in place and to allow replacement of LED circuit 108 when removed.

As illustrated, when a driver module 105 is coupled to the illumination module 103, the combined system has a dimensionality 104. In the illustrated embodiment, the combined system has a tubular profile that is dimensioned for installation in a pre-existing fluorescent light troffer fixture. For example, the system may have a diameter and length allowing it to be installed in a "T" designation fluorescent fixture, such as a T5, T8, or T12 lamp fixture. In these embodiments, electrical contacts 106 may comprise pins configured to engage with a pre-existing troffer's double or single pin sockets, or "tombstones."

In further embodiments, other physical profiles may be employed such that the system may be installable in other fixture types. For example, a standard LED fixture, a standard incandescent light fixture, or a circular fluorescent standard. In some environments, for example an environment employing troffer style fluorescent fixtures, the fixtures may be provided with existing ballast circuitry. For example, a tubular fluorescent light fixture may have a corresponding installed fluorescent light ballast in electrical contact with the fixture. Accordingly, in some embodiments, the driver circuit 111 may be pre configured to condition the type of power generated by the fluorescent light ballast into a suitable profile for powering the LED circuit 108. In such an embodiment, an installer would not be required to rewire an existing fixture, and could simply install the embodiment as a replacement light tube. In other embodiments, the driver 111 could be configured to condition other power, such as main electricity, to power the LED circuit 108. For example, such embodiments might be employed to replace pre-existing fluorescent fixtures as their fluorescent ballasts fail, or as a wholesale replacement of a fluorescent lighting system without requiring the physical remodeling that would be required to replace the fluorescent troffer systems. Further, direct conversion of main power may be more energy efficient than conversion of ballast power, so energy savings may be gained by electrically bypassing a pre-existing fluorescent ballast.

Figure 2:
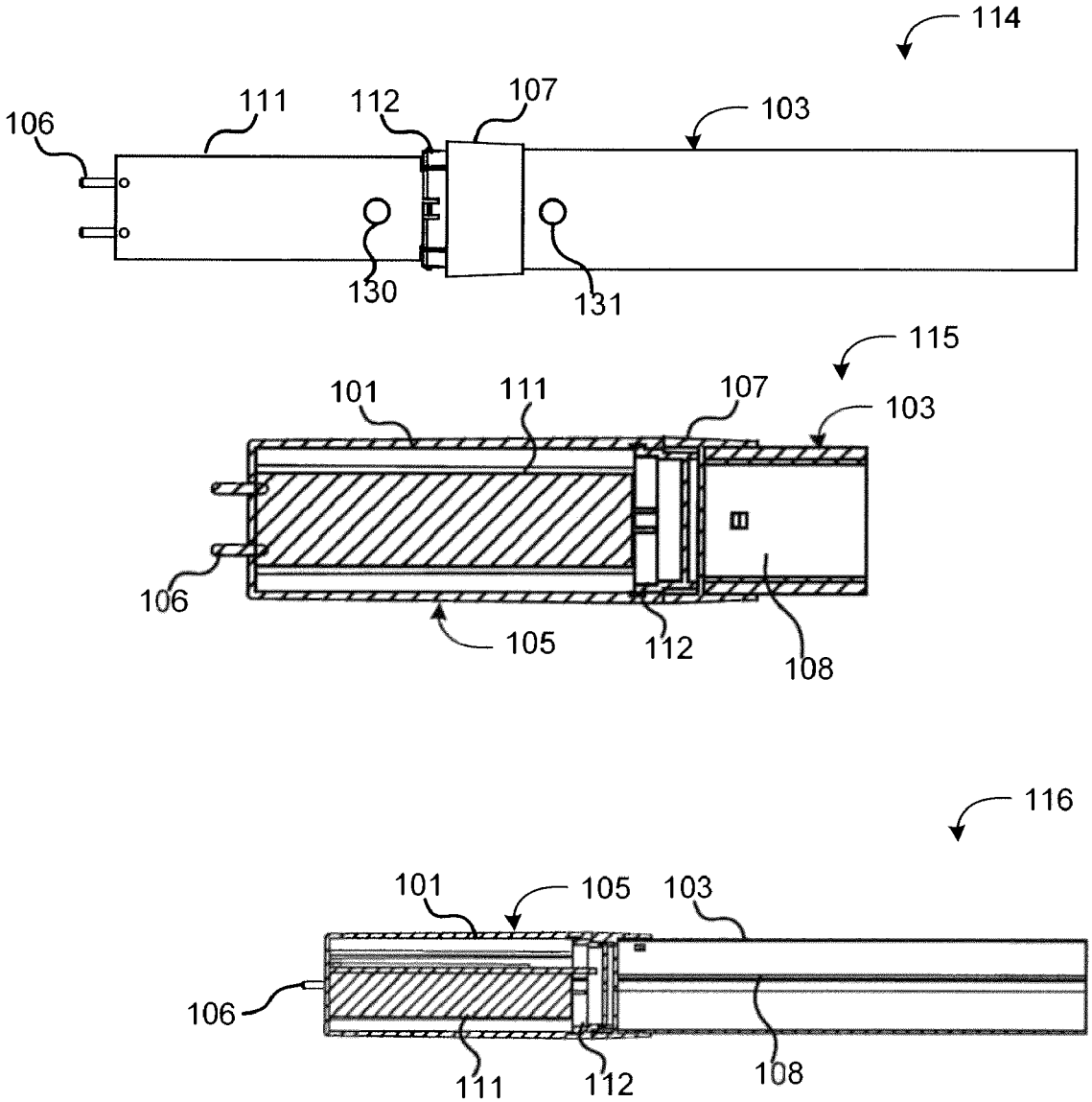
FIG. 2 illustrates various side views of a driver module coupled to an illumination module according to an embodiment of the invention.

FIG. 2 illustrates various side views of a driver module coupled to an illumination module according to an embodiment of the invention. View 114 is a side view of a driver circuit 111 as it would appear with housing 101 removed. View 115 is a cutaway side view of an illumination system, and view 116 is a cutaway side view rotated 90° with respect to view 115. In the illustrated embodiment, a coupling module 107 is fixedly connected to the illumination module 103, and in some embodiments may comprise, a component of illumination module 103. A corresponding coupling module 112 may be joined to the housing 101 of the driver module 105. As illustrated, the first coupling module 107 may comprise a receptacle configured to receive the second coupling module 112 when the driver module is engaged with the illumination module. As further illustrated, this engagement allows the driver circuit 111 to electrically couple to the LED circuit 108, and maintains this coupling during system operation. In various embodiments, this coupling may be obtained in various ways. For example, coupling module 112 may be configured to screw into coupling module 107 or vice versa; the coupling modules 112 and 107 may be configured to frictionally engage one another; or one coupling module may be engaged with the other through notches or other means of connection. Although illustrated as separate structures, in some embodiments, coupling modules 112 and 107 may be integrated into the structures of the driver module 105 or the illumination module 103. For example, coupling module 112 part of a continuous structure formed by coupling module 112 and housing 101. Similarly, coupling module 107 may form part of a continuous structure formed by coupling module 112 and housing 102.

In further embodiments, various mechanisms may be deployed to indicate the status of various components of the systems described herein. For example, an LED 130 or an LED 131 may be coupled to the driver module or illumination module, respectively, to indicate the health of the driver module. Such an LED may be electrically coupled to the driver circuit 111. In the case of an LED 130 coupled to the driver module 105, the LED 130 may be disposed in the housing 101, or a window may be disposed in housing 101, and the LED 130 may be in permanent electrical connection to the driver circuit 111. In the case of an LED 131 coupled to the illumination module 103, the LED 131 may be configured to electrically couple to the driver circuit 111 when the driver module 105 is coupled to the illumination module 103. In either case, the LED 130 or 131 may be configured to activate if a component in the driver circuit 111 is close to failure. Accordingly, a system user or maintainer can be alerted to an impending failure and replace the driver module 105 before the system is deactivated.

Figure 3A:
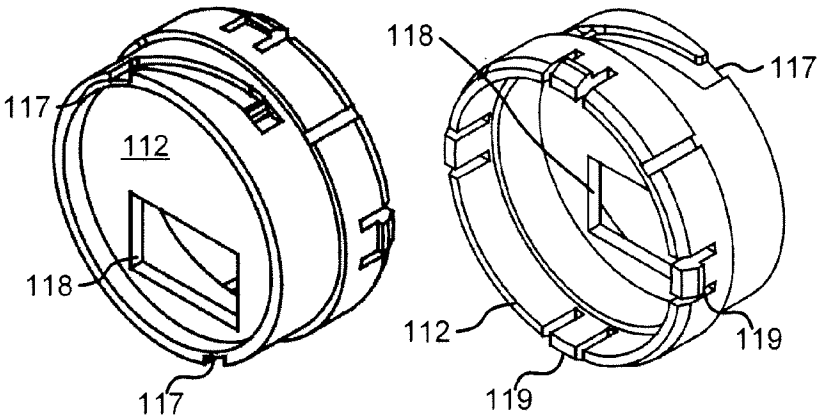
FIG. 3 illustrates side views and perspective views of a portion of an engaging module for a driver module according to an embodiment of the invention.
Figure 3B:
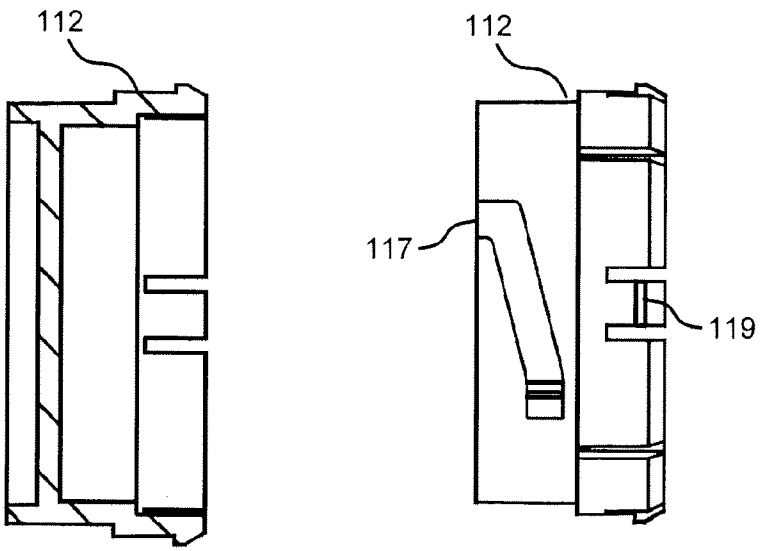

FIG. 3 illustrates side views and perspective views of a portion of an engaging module for a driver module according to an embodiment of the invention. In the illustrated embodiment, the engaging module comprises a cap 112 for a driver module that engages with a corresponding cap for an illumination module (illustrated in FIG. 4). FIG. 3A illustrates front perspective and back perspective views of a cap 112, whereas FIG. 3B illustrates a side view and a cutaway side view of cap 112. With further reference to FIG. 2, the illustrated cap 112 is configured to engage with the housing 101 of the driver module 105 to provide a means of releasable engaging with an illumination module 103. In the illustrated embodiment, the cap 112 is connected to the driver housing 101 at a first side. For example, a plurality of tabs 119 may be disposed on the first side to engage with corresponding notches in the driver housing 101 such that the cap is fixed to the housing during normal operations. In some embodiments, this connection to the housing 101 may also be releasable. For example, the cap 112 may be configured to remain in place during normal systems operations, and during replacement of the driver module 105. Furthermore, the cap 112 may be configured so that it is removable after the driver module 105 has been removed from the illumination module. For example, a defective or used driver module 105 may be repaired by removing the cap 112 and replacing the driver circuit disposed in the module.

In the illustrated embodiment, the cap 112 is configured to engage with a corresponding portion of the illumination module 103 to allow the driver module to be replaceable. Here, the means of engagement comprises a groove 117 that is disposed on the connecting side. This groove engages with a corresponding tab on the illumination module, as described below, to provide a means of engagement whereby the driver module can be connected to the illumination module by threading the groove 117 with the tab by displacing the driver module parallel to the axis of the tube and then by rotating the driver module about the axis, such that the illumination module and driver module releasable lock together. The illustrated embodiment further comprises a portal 118 configured to allow electrical coupling between the driver circuit 111 and the LED circuit 108.

Figure 4:
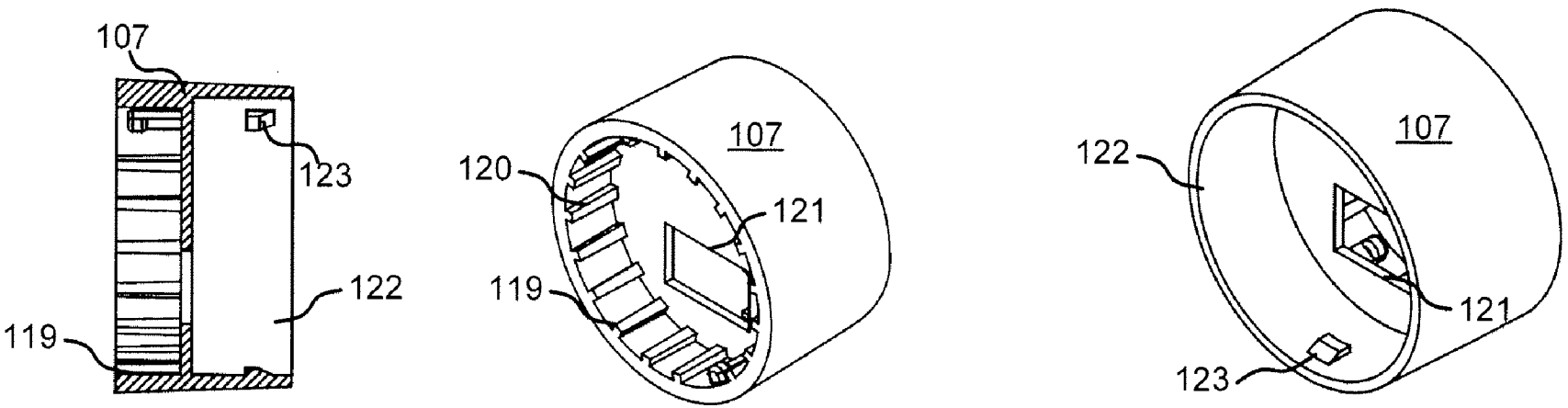
FIG. 4 illustrates a portion of an engaging module for an illumination module according to an embodiment of the invention.

FIG. 4 illustrates a portion of an engaging module for an illumination module according to an embodiment of the invention. In the illustrated embodiment, the engaging module comprises a cap 107 for the illumination module 103 that engages with a corresponding cap for the driver module (as illustrated in FIG. 3). FIG. 4 comprises a cutaway side view, a front perspective view, and a rear perspective view of cap 107. The illustrated embodiment comprises a portion 119 configured to engage with the housing 102 of the illumination module 103. For example, the housing 102 may be inserted into the portion 119 and kept in place through tabs or through compressive force provided by a plurality of ridges 120. In some embodiments, the portion 119 may be configured to maintain the connection to the housing 102 during normal system operations but may be removable after the system has been disassembled. For example, the cap 107 may be removable from the illumination module 103 to allow the illumination circuit 108, or other components such as heat sinks, to be removed or replaced as needed.

The illustrated embodiment further comprises a portion 122 configured to engage with the cap 112 of the driver module 105. As illustrated, and as described above, the portion 122 further comprises a tab 123 that engages with a groove 117 disposed on cap 112. Accordingly, the driver module may be coupled to the illumination module by inserting the cap 112 portion of the driver module into portion 122 such that the groove 117 engages with the tab 123 to releasable lock the driver module into place. Similar to cap 112, the illustrated cap 107 further comprises a portal 121 configured to allow electrical flow between the driver circuit 111 and the LED circuit 108.

Figure 5:
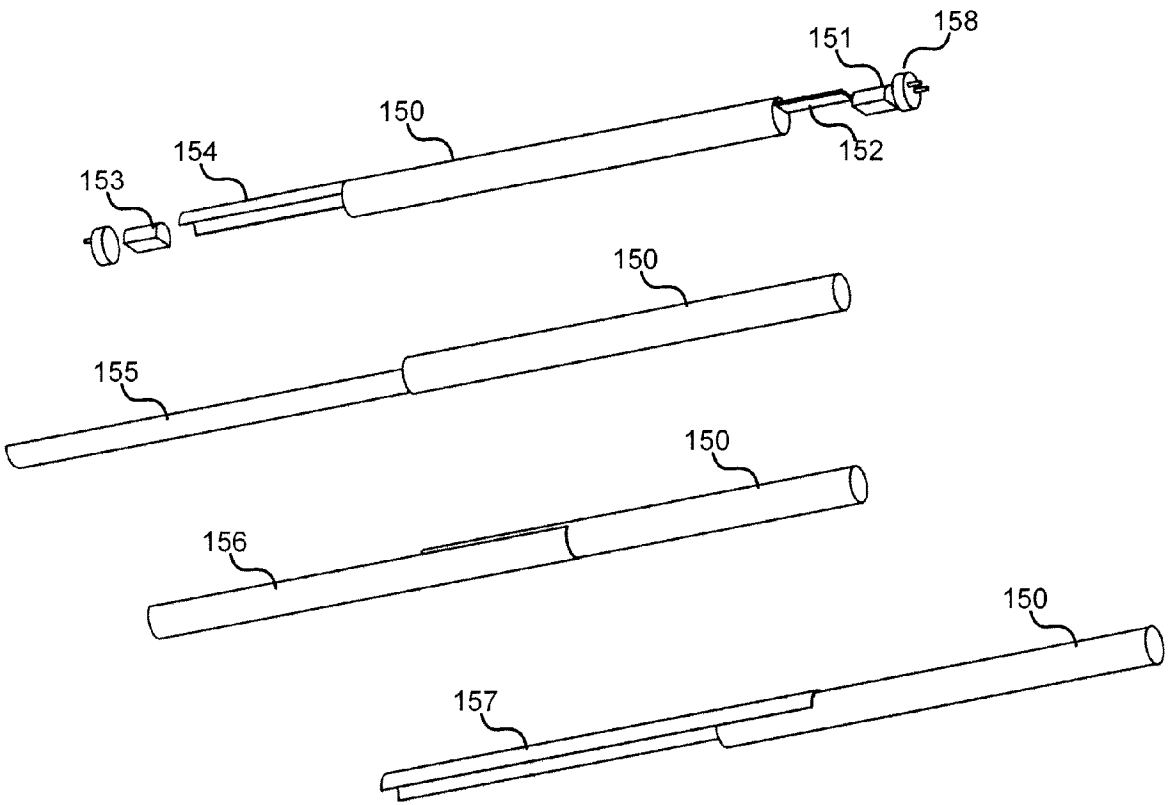
FIG. 5 illustrates an alternative modular LED lighting system according to another embodiment of the invention.

FIG. 5 illustrates an alternative modular LED lighting system according to another embodiment of the invention. In this embodiment, a replaceable driver module 151 comprises an internally replaceable driver module 151 that is configured to engage with an LED circuit comprising a plurality of LEDs on a circuit board electrically coupled to the driver 151. In this embodiment, the internal driver module 151 is maintained within the tube 150 through a cap 158 that engages with tube 150 in a releasable manner, for example through a similar tab and groove system as described with respect to FIGS. 4 and 5. Accordingly, in this embodiment, the driver module 151 is replaceable by removing the cap 158 to allow access to the driver module 151. In some embodiments, a second driver module 153 may be provided, for example as a backup to the first driver module 151. In some of these embodiments, the tube 150 may comprise a storage for the second driver module 153, such that driver module 153 may be used to replace driver module 151 when it ceases functioning. In further embodiments, the driver module 153 may be equipped with its own electrical connection to LED circuit 152 such that driver module 153 may be used to power the LED circuit 152 when the first driver module 151 fails without moving the second driver module 153.

The illustrated embodiment further comprises a variety of additional components that may be employed in some embodiments alone or in combination. For example, an internal heat sink 154 may be disposed within the tube 150. In some embodiments, this heat sink may be permanently joined with the tube 150, for example, if the tube 150 was made of a heat conducting material, and a portion of the tube were configured to extend to engage or contact the driver circuit 152. In other embodiments, the heat sink 154 may be removable and replaceable, for example through the same means 158 used for replacing the driver module 151.

An internal diffuser or lens 155 may further be provided to cause the lighting system to provide a more diffuse or distributed light, or to focus or direct the light produced during systems operation to a particular location. In some embodiments, this internal diffuser or lens 155 may also comprise a material component of the tube 150, or the diffuser or lens 155 may be removable or replaceable. In further embodiments, external diffusers or lenses 156 or external heat sinks 157, or a combination of any of these components, may be employed. Accordingly, various system configurations may be formed by choosing various combinations of such components. Furthermore, although discussed with respect to the embodiment of FIG. 5, these components 154, 155, 156, and 157 may be employed and implemented in embodiments described with respect the other Figures and accompanying descriptive material.

Figure 6:
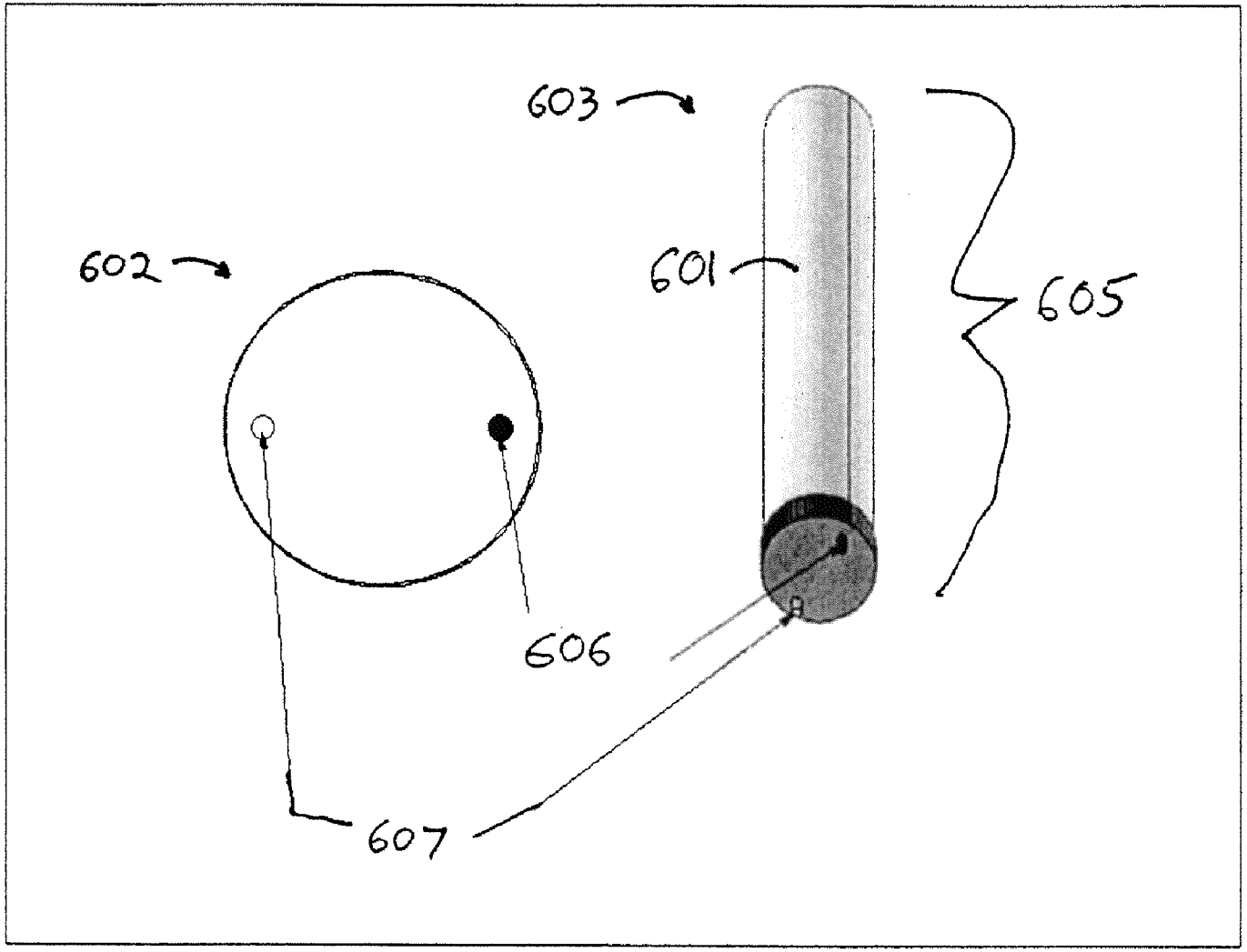
FIG. 6 illustrates end and perspective views of an alternative driver module according to an embodiment of the invention.

FIG. 6 illustrates end and perspective views 602, 603, respectively, of an alternative driver module 605 according to an embodiment of the invention. Similar to previous driver module embodiments, the driver module 605 is attachable to an LED illumination module (e.g., LED illumination module 103 of FIG. 2). The driver module 605 comprises a driver circuit disposed within driver housing 601. This embodiment features an alternative pin arrangement, wherein metallic pin 606 comprises an electrical contact 606 providing an AC electrical connection, and non-metallic pin 607 provides a fixture specific non-electrical connection. Electrical contact 606 is electrically coupled to the driver circuit within driver housing 601. The driver circuit may comprise any suitable electrical circuit configured to condition electricity for powering a plurality of LEDs. For example, the driver circuit may comprise a conventional constant current source configured to convert electricity received via contact 606 to have suitable characteristics for LED use.

Figure 7:
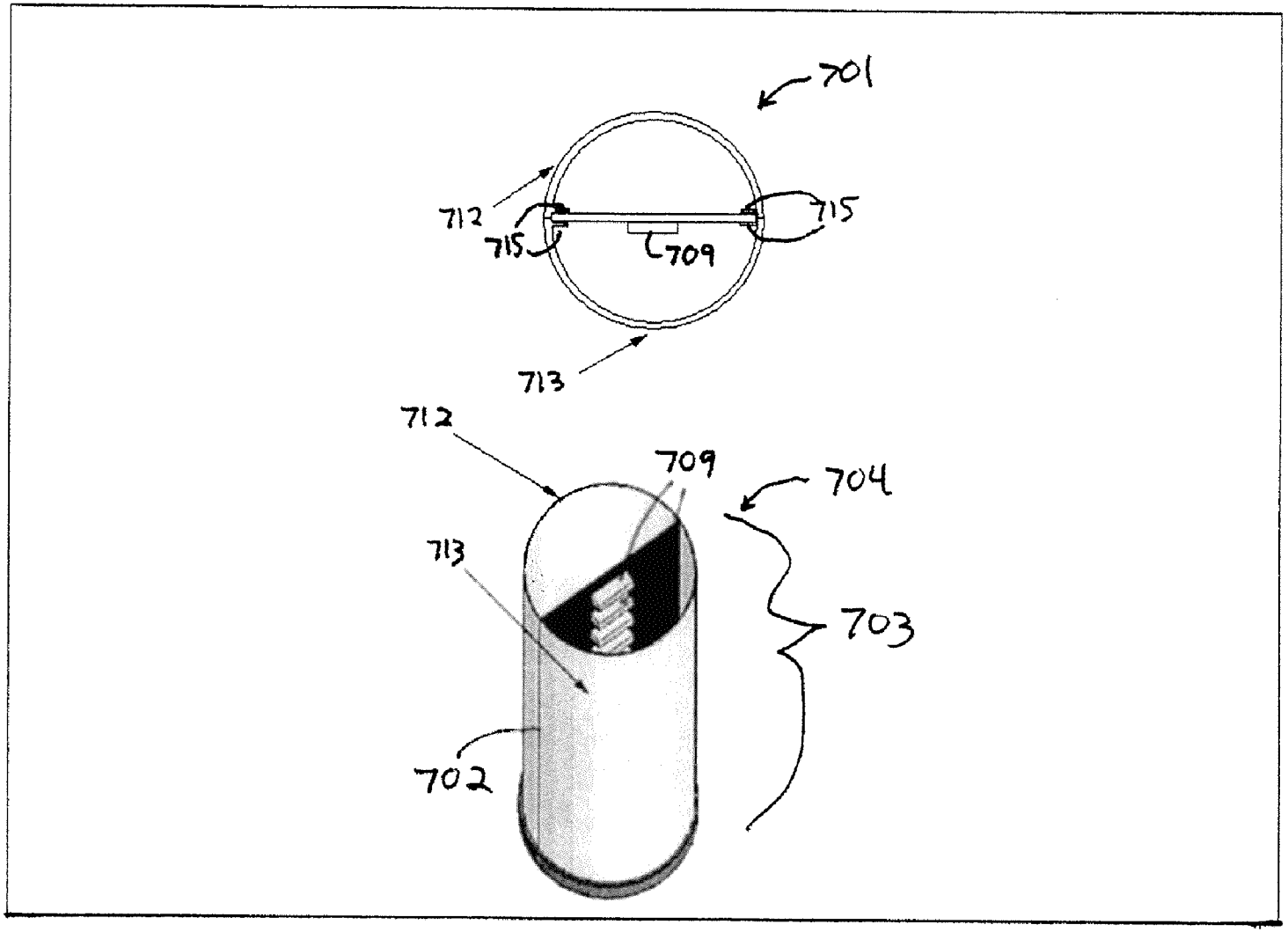
FIG. 7 illustrates cross-sectional and perspective sectional views of an alternative illumination module according to an embodiment of the invention.

FIG. 7 illustrates cross-sectional and perspective sectional views 701, 704, respectively, of an alternative illumination module 703 according to an embodiment of the invention. The illustrated illumination module 703 comprises a housing 702 having a circuit board 708 with a plurality of LEDs 709 disposed therein. In this embodiment, the housing 702 comprises a dual lens tube 702 having a first section 712 and a second section 713 comprising tube halves separated by a plane defined by circuit board 708. These tube sections 712, 713 may comprise various combinations of lenses including, but not limited to, clear, frosted, colored, warm white and cool white lenses. By way of example, section 712 may comprise a clear lens, while section 713 may comprise a frosted lens. In another example, section 712 may again comprise a clear lens, whereas section 714 may comprise a colored lens. Any combination of lenses may be employed to create a dual lens tube 702. To change the quality of light emitted by illumination module 703, a user removes the circuit board 708 from the dual lens tube 702 by sliding it out of the tube through guides 715, rotates its orientation such that the LEDs 709 face the opposite tube section 712, and slides the circuit board 708 back into the dual lens tube 702 through guides 715.

Similar to previous embodiments, the LEDs 709 are configured to be powered by electricity received from the driver module (such a driver module 105 or driver module 605) when the illumination module 703 is connected to the driver module. In some embodiments, the LEDs 709 may be coupled to a circuit board 108 in a conventional manner, and the circuit board 708 may be configured such that it is placed in electrical communication with pin(s) (e.g., pins 106 or pin 606) and the LED driver circuit when the driver module is coupled to the illumination module 703.

Figure 8A:
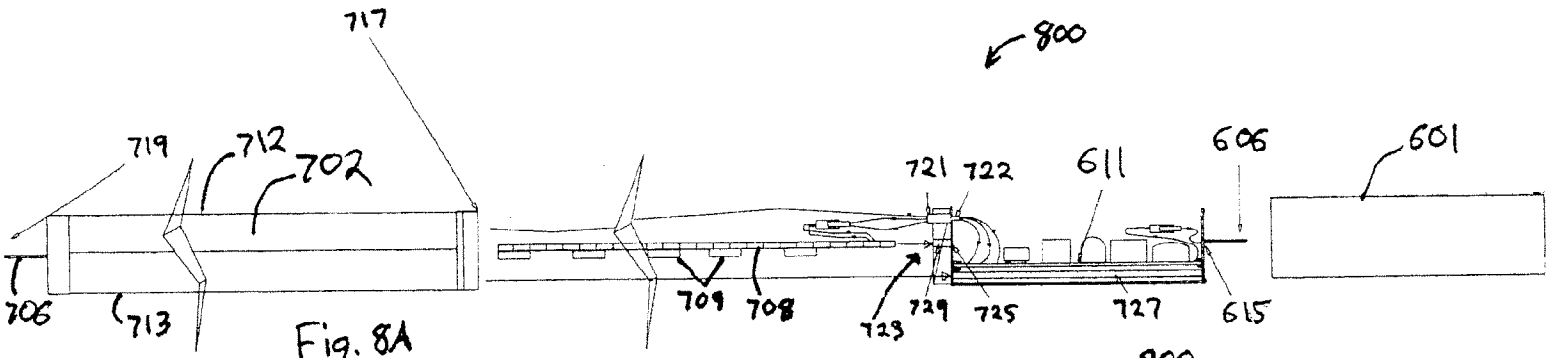
FIG. 8A illustrates an exploded side view of a light tube assembly having a driver module coupled to an illumination module according to an embodiment of the invention.
Figure 8B:
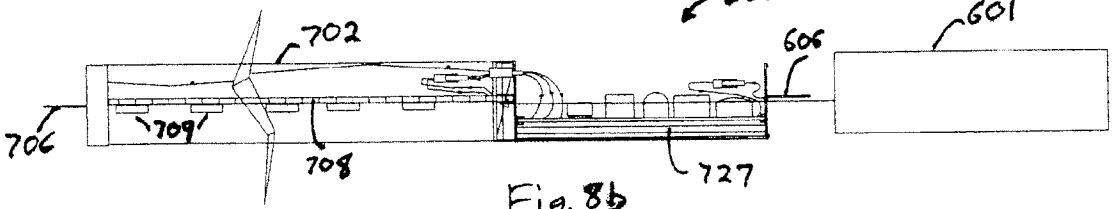
FIG. 8B illustrates a side sectional view of the light tube assembly of FIG. 8A wherein the light tube and driver cradle are assembled.

FIG. 8A illustrates an exploded side view of the light tube assembly 800 having a driver module 605 coupled to an illumination module 703 according to an embodiment of the invention. Similar to previous embodiments, the driver module 605 comprises a driver circuit 611 disposed within a driver housing 601. FIG. 8B illustrates a side sectional view of the light tube assembly 800 of FIG. 8A wherein the light tube and driver cradle are assembled, FIG. 8C illustrates a side sectional view of the fully assembled light tube assembly 800, and FIG. 8D illustrates a side sectional view of a portion of the light tube assembly 800.

Referring to FIGS. 8A-8D, the illumination module 703 comprises a dual lens tube 702 having first and second section tube sections 712, 713 that may comprise various combinations of lenses including, but not limited to, clear, frosted, colored, warm white and cool white. The driver end 717 of the dual lens tube 702 may be attached to the driver housing 601 by any number of means. By way of example, the tube 702 and driver housing 601 may be screwed together, attached via snap fit or twist pressure, attached via slots, or glued together. In some embodiments, this connection may feature an additional tension ring. The other end 719 of the tube 702 may include a single metallic pin 706 comprising an electrical contact 706 providing an AC electrical connection to the driver circuit 611. Some embodiments may feature a second pin comprising a non-metallic pin providing a fixture specific non-electrical connection.

The illumination module 703 further comprises a circuit board 708 having a plurality of LEDs 709 disposed within. The circuit board 708 features a DC electrical connector 721 that may be disconnected from DC wires 722 to allow light element upgrade, replacement, or rotating to allow a different light quality, such as described with respect to FIG. 7. In addition, the circuit board includes an AC connection 723 at the isolator section 725 of the driver cradle 727. An alignment slot 729 is provided within the driver cradle 727 to provide a guide for the circuit board 708 such that the circuit board 708 may slide into the slot 729 to provide the AC connection. The isolator 725 comprises a wall that insulates the driver module 605 from the illumination module 703. The driver module 605 is detached from the illumination module 703 to allow for replacement or repair of the driver. A single metallic pin 606 comprising an electrical contact 606 is provided at the end 615 of the driver to provide AC power. In the illustrated embodiment, an AC connection is provide from both ends of the light tube assembly (i.e., pins 606, 706) via a wire or wires that extend through the light tube assembly 800 from pins 606, 706 to the driver circuit 611.

Figure 8D:
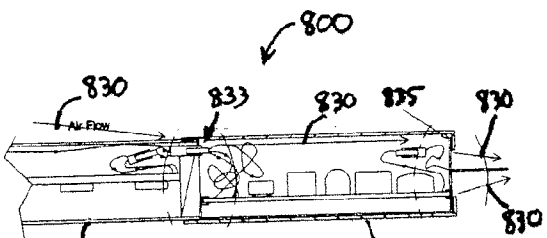
FIG. 8D illustrates a side sectional view of a portion of the light tube assembly of FIG. 8A.
Figure 8C:
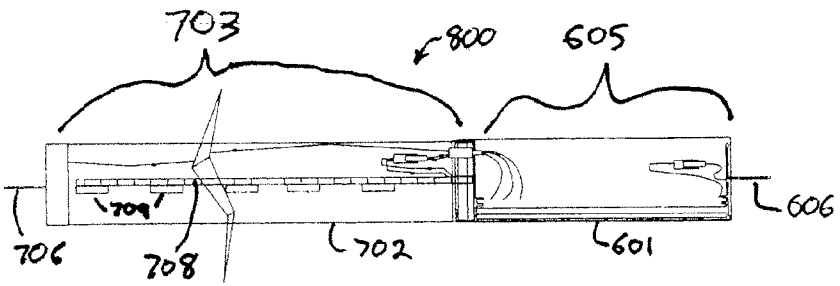
FIG. 8C illustrates a side sectional view of the fully assembled light tube assembly of FIG. 8A.

Referring to FIG. 8D, the driver module 605 of the light tube assembly 800 is depicted in cross-section and the cross flow ventilation of the driver module 605 is illustrated. Specifically, the airflow within the driver module 605 is depicted by arrows 830. The airflow is subject to the physics of the air, which causes the air to flow from hotter to cooler locations. Slots 833 in the driver housing 601 at the junction of the illumination module 703 and the driver module 605 are formed to allow air to flow into the driver module 605. Additional slots 835 are provided at the other end 615 of the driver housing 601 to allow the heated air to flow out of the driver module 605.

Figure 9A:
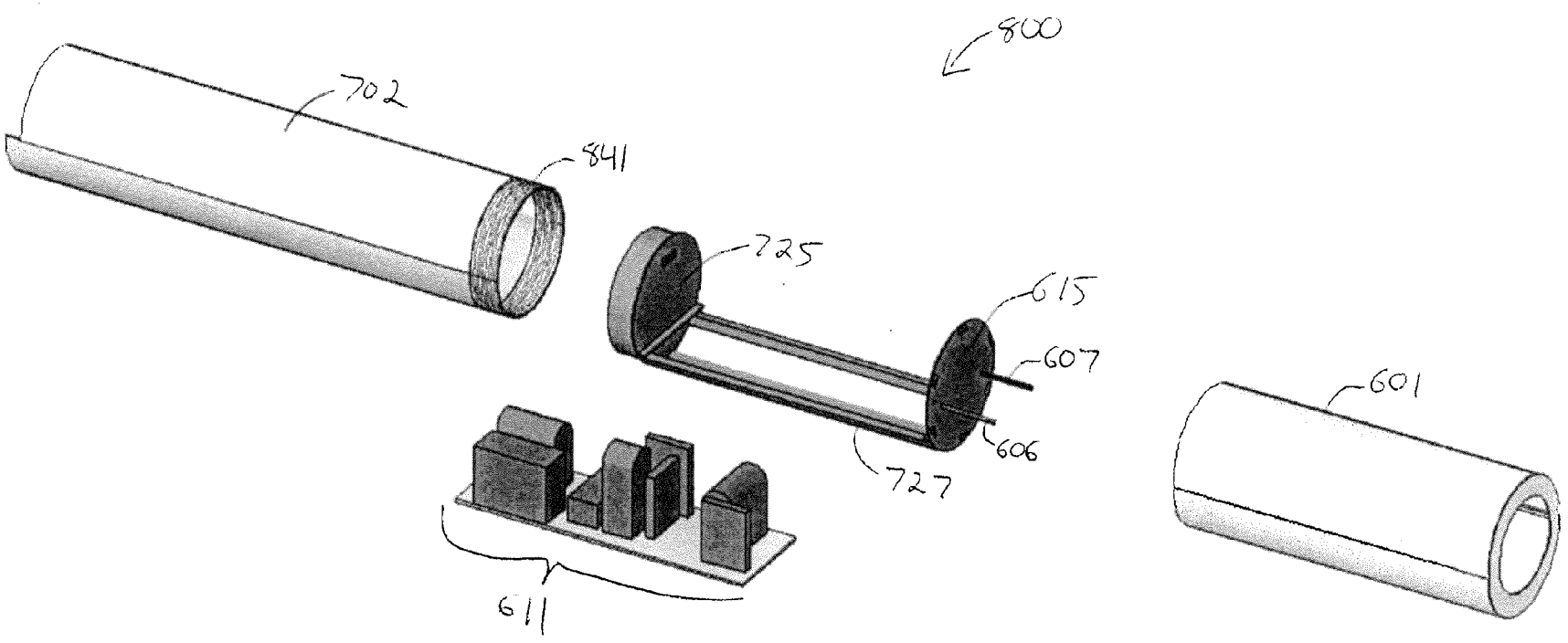
FIG. 9A illustrates an exploded perspective view of the light tube assembly of FIGS. 8A-8D having a driver module coupled to an illumination module according to an embodiment of the invention.
Figure 9B:
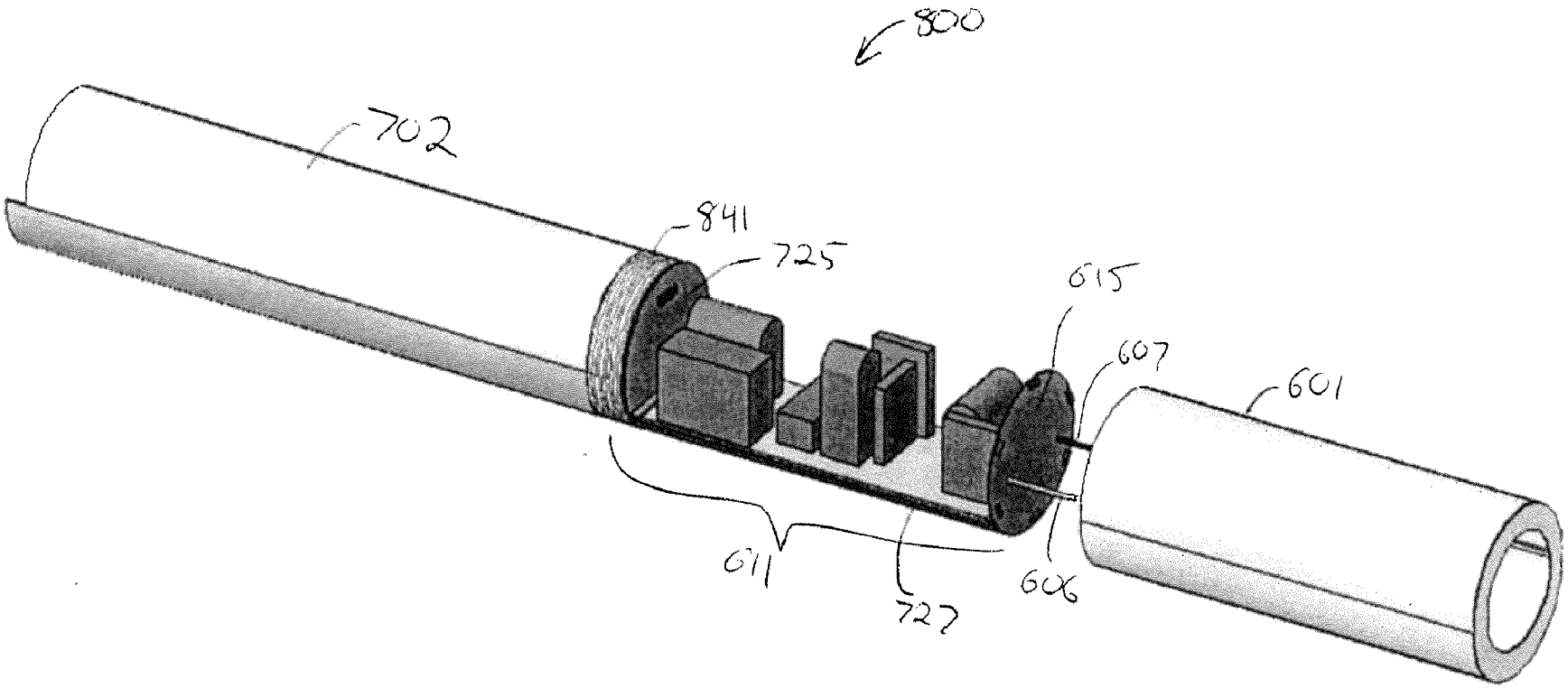
FIG. 9B illustrates a perspective view of the light tube assembly of FIG. 9A wherein the driver cradle is assembled.

FIG. 9A illustrates an exploded perspective view of the light tube assembly 800 of FIGS. 8A-8D having a driver module 605 coupled to an illumination module 703 according to an embodiment of the invention. Similar to previous embodiments, the driver module 605 comprises a driver circuit 611 disposed within a driver housing 601. FIG. 9B illustrates a perspective view of the light tube assembly 800 of FIG. 9A wherein the driver cradle is assembled, while FIG. 9C illustrates a perspective view of the fully assembled light tube assembly 800.

Figure 9C:
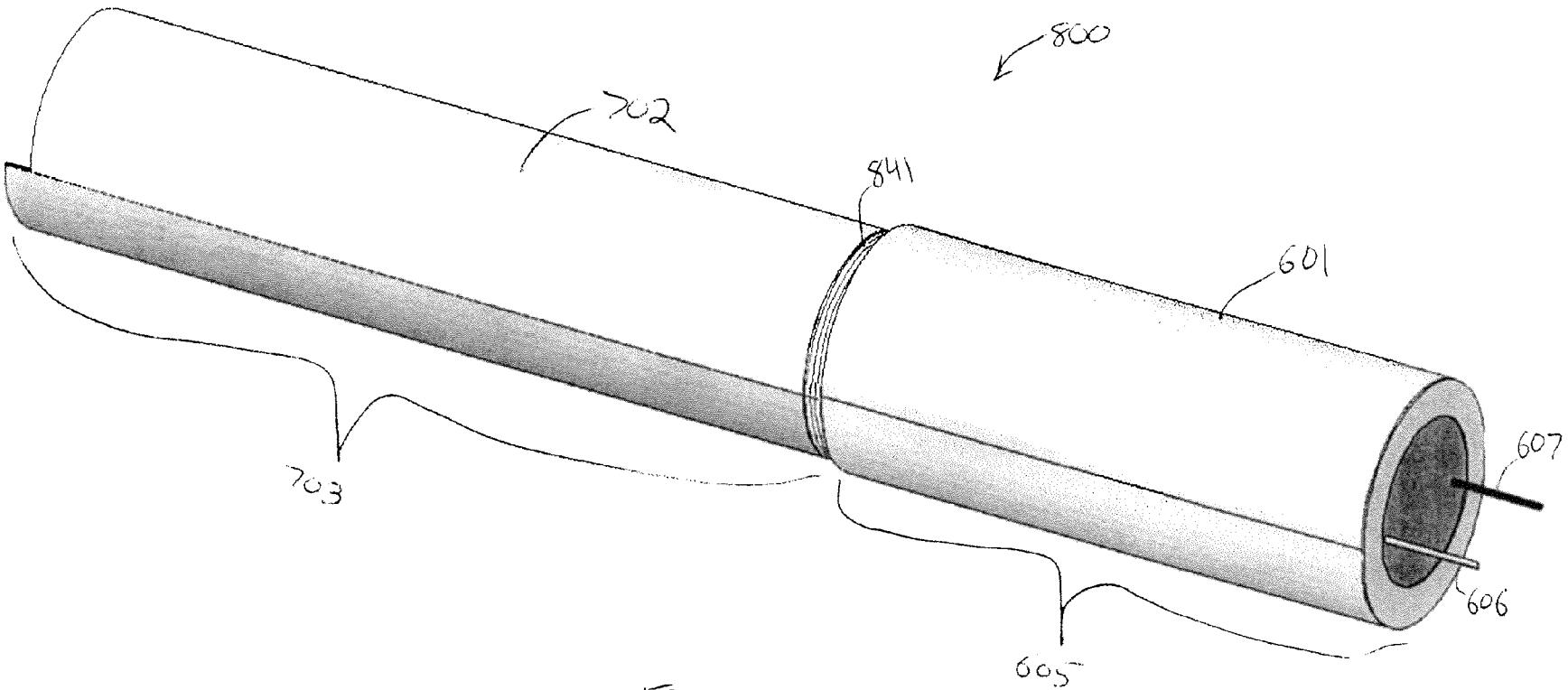
FIG. 9C illustrates a perspective view of the fully assembled light tube assembly of FIG. 9A.

Referring to FIGS. 9A-9C, in the illustrated embodiment the tube 702 and driver housing 601 are screwed together via threads 841 on tube 702 and corresponding threads (not shown) within driver housing 601. In some embodiments, this connection may feature an additional tension ring. The driver housing 601 is detached from the tube 702 to allow for replacement or repair of the driver. This embodiment features an alternative pin arrangement, wherein metallic pin 606 comprises an electrical contact 606 providing an AC electrical connection, and non-metallic pin 607 provides a fixture specific non-electrical connection. Electrical contact 606 is electrically coupled to the driver circuit within driver housing 601.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A modular lighting system, comprising:

an illumination module comprising a first housing and a plurality of electrically coupled LEDs disposed within the within the first housing; and a driver module comprising a second housing configured to physically couple and de-couple from the illumination module, and an LED driver disposed within the second housing and configured to provide an electrical current to drive the plurality of LEDs when the driver module is coupled to the illumination module;

wherein the illumination module and the driver module each include a single metallic pin comprising an electrical contact for providing an AC electrical connection to the LED driver.

2. The system of claim 1, wherein the illumination module and the driver module each include a second pin comprising a non-metallic pin for providing a fixture specific non-electrical connection.

3. The system of claim 1, wherein the driver module further comprises a cap coupled to the second housing and configured to interface with the illumination module to couple the driver module to the illumination module.

4. The system of claim 3, wherein the cap is removable from the second housing and the LED driver is removable from the second housing when the cap is removed.

5. The system of claim 3, wherein the illumination module further comprises a sealing element coupled to the first housing and configured to engage with the cap of the driver module when the driver module is coupled to the illumination module.

6. The system of claim 5, wherein the sealing element is manually removable to allow replacement of at least one of the LEDs.

7. The system of claim 1, wherein the LEDs are electrically coupled to a printed circuit board disposed within the housing, and wherein the illumination module further comprise a heat sink disposed within the first housing.

8. The system of claim 1, wherein the illumination module and the driver module have form factors such the system is installable in a pre-existing troffer light fixture when the driver module is coupled to the illumination module.

9. The system of claim 1, wherein the first housing comprises a dual lens tube having a first section and a second section comprising tube halves separated by a plane defined by an LED circuit board.

10. The system of claim 9, wherein the tube halves comprise a combination of lenses selected from the group consisting of clear lenses, frosted lenses, colored lenses, warm white lenses and cool white lenses.

11. A driver module for an LED illumination system, comprising:

a first housing configured to physically couple and decouple from an illumination module; and an LED driver disposed within the first housing and configured to provide an electrical current to drive the plurality of LEDs when the driver module is coupled to the illumination module;

wherein the illumination module comprises a second housing and a plurality of electrically coupled LEDs disposed within the within the second housing;

wherein the first housing comprises a dual lens tube having a first section and a second section comprising tube halves separated by a plane defined by an LED circuit board.

12. The driver module of claim 11, wherein the tube halves comprise a combination of lenses selected from the group consisting of clear lenses, frosted lenses, colored lenses, warm white lenses and cool white lenses.

13. The driver module of claim 11, wherein the driver module further comprises a cap coupled to the first housing and configured to interface with the illumination module to couple the driver module to the illumination module.

14. The driver module of claim 13, wherein the cap is removable from the first housing and the LED driver is removable from the first housing when the cap is removed.

15. The driver module of claim 13, wherein the illumination module further comprises a sealing element coupled to the second housing and configured to engage with the cap of the driver module when the driver module is coupled to the illumination module.

16. The driver module of claim 15, wherein the sealing element is manually removable to allow replacement of at least one of the plurality of the LEDs.

17. The driver module of claim 11, wherein the LEDs are electrically coupled to the LED circuit board disposed within the housing, and wherein the illumination module further comprises a heat sink disposed within the first housing.

18. The driver module of claim 11, wherein the illumination module and the driver module have form factors such the system is installable in a pre-existing troffer light fixture when the driver module is coupled to the illumination module.

* * * * *